US005955688A

United States Patent [19]

Cook

[11] Patent Number: 5,955,688

[45] Date of Patent: Sep. 21, 1999

[54] COMPOSITE STRING INSTRUMENT APPARATUS AND METHOD OF MAKING SUCH APPARATUS

[76] Inventor: Richard L. Cook, 444 Lake Mary Rd., Flagstaff, Ariz. 86001

[21] Appl. No.: 08/918,716

[22] Filed: Aug. 22, 1997

Related U.S. Application Data

[63] Continuation-in-part of application No. 08/645,450, May 13, 1996, abandoned.

[51] Int. Cl.[6] ..... G10D 3/00

[52] U.S. Cl. ..... 84/291; 84/452 R

[58] Field of Search ..... 84/291, 452 R, 84/452 P, 275

[56] References Cited

U.S. PATENT DOCUMENTS

| | | | |
|---|---|---|---|
| 360,317 | 3/1887 | Loppentein . | |
| 4,408,516 | 10/1983 | John | 84/275 |
| 4,838,140 | 6/1989 | Meissner | 84/275 |
| 4,969,381 | 11/1990 | Decker, Jr. et al. | 84/291 |
| 5,396,823 | 3/1995 | Hoshino | 84/291 |
| 5,406,874 | 4/1995 | Witchel | 84/291 |

*Primary Examiner*—Jeffrey W. Donels
*Attorney, Agent, or Firm*—H. Gordon Shields

[57] ABSTRACT

A string instrument, such as a violin, is made of graphite fiber cloth and unidirectional graphite fiber sheets and epoxy resin. The instrument includes a unitary body, including a back, a rib, a neck, and a pegbox, all molded as a single or unitary element. A belly and a soundboard are separately molded of the same material and they are appropriately secured to the body. A string assembly is secured to the body and disposed over the belly. A pair of reinforcing struts are secured to the neck and to the rib. A sound post is disposed between the back and the belly, and a bridge is disposed on the belly, and strings of the string assembly are secured to pegs extending through the pegbox, over the bridge, and to a tail piece. The tail piece is in turn secured to the rib by an end pin remote from the neck.

17 Claims, 2 Drawing Sheets

COMPOSITE STRING INSTRUMENT APPARATUS AND METHOD OF MAKING SUCH APPARATUS

CROSS REFERENCE TO RELATED APPLICATION

This application is a Continuation In Part application of Ser. No. 08/645,450, now abandoned, filed May 13, 1996.

BACKGROUND OF THE INVENTION

1. Field of the Invention

This invention relates to string instruments, such as violins and, more particularly, to a composite string instrument and a method of making a string instrument.

2. Description of the Prior Art

The construction of the violin and other string instruments of its family has changed very little since the 16th century, when well-known artisans such as Stradivari, Guarneri and Amati mastered the craft. Their instruments are considered the best for tone, power, beauty and, of course, investment. Because they are so rare and so expensive, it is not often that a person even gets to hear and see one played. Wooden instruments of this type are a thing of beauty, and also a delicate, fragile, never-can-be-replaced piece of workmanship.

The violin itself comprises a soundbox, a neck, a pegbox, and four strings stretched tightly over the soundbox. The strings attach to a device at the lower end called a tailpiece, extend over a bridge near the center of the soundbox, and continue to the tuning pegs within the pegbox at the upper or distal end of the instrument. When the string is vibrated by plucking or by drawing a bow over it, it induces a vibrational energy through the bridge to the top and bottom plates of the soundbox (hereafter called the "belly" and the "back"). The vibration of these plates enhances and amplifies the vibration initiated at the string, and sound is produced. The belly and back are connected around their perimeter by a sidewall called the rib, and are additionally connected by a column called a sound post.

Because of the tedious and exacting workmanship involved in the making of wooden instruments, there have been numerous attempts to fashion instruments out of synthetic materials over the past few decades. The idea is that with proper tooling, a consistent, easily manufactured instrument might be produced. However, the mass market for such instruments has not been attained for various reasons, such as poor sound quality, inferior looks, or problems involved in the conjunction of both synthetic and natural wood materials together in the same instrument.

In U.S. Pat. No. 3,699,836 (Glasser), a violin is produced using sheets of fiberglass overlaid with a wood paper to simulate the wood look of the natural instrument. This instrument design calls for the belly, back, and rib to be separate pieces, and incorporates a wooden neck and pegbox. The problem with this very typical design for composite instruments is that with all these glue joints, the instrument is more difficult to manufacture. Also, it has much of the fragile nature that the wooden counterparts have. If such an instrument were to be dropped, it would likely break at the glue joints. Elimination of as many of these joints as possible is thus desirable in the manufacture of composite instruments. Also, the preferred medium at this date is graphite fiber within an epoxy resin matrix, and Glasser's claims extend only to fiberglass.

The use of graphite/epoxy materials for musical instruments is taught by U.S. Pat. No. 3,880,040 (Kaman). This invention calls for unidirectional (all strands of fiber going the same direction) graphite layers on both top and bottom faces of a wooden core. The idea is to reduce the thickness of the soundboard by using stiffer materials on the outside of the wooden core. Such an instrument would then still exhibit the pleasant sound derived from a completely wooden instrument, but would also project higher frequencies of vibration because of the thinness of the soundboard.

A disadvantage to such a construction is that over time the wood can delaminate from the graphite/epoxy surfaces. Also, as violin makers are keenly aware, wood has natural variances within from piece to piece, so that a maker could not guarantee consistency of sound from instrument to instrument. Finally, the disadvantage noted above in Glasser's work would apply here, in that the instrument would still be constructed of several pieces that would need to be glued together, and a fragile instrument would still be the result.

In U.S. Pat. No. 4,161,130 (Lieber), a completely synthetic combination of both the lower soundboard and sidewalls (ribs) is found. The invention is for a bass guitar, and is bowl shaped. Because of the complete synthetic nature of the materials, sound control and response to vibration would be more consistent. The disadvantage of this invention is that the neck is bonded or attached separately to the bowl shaped body, and the instrument could easily break at this joint if it were dropped.

Another method of constructing musical instrument soundboxes is taught by U.S. Pat. No. 4,144,793 (Soika and Gene). Rotational molding of plastics involves putting a specific amount or "charge" of plastic powder into a closed cavity mold, and rotating the mold around two axes while concurrently heating the mold to a temperature in which the plastic powder will melt. The mold is then cooled while still rotating, and then disassembled and the part removed. Soika et al proposes making soundboxes for instruments in this manner. The same problem as stated above with this construction is that the neck is bonded secondarily, and is a potential point of breakage. Also, it is well known that acoustic instrument making involves exacting tolerances of the thickness of the soundboards, and rotational molding does not attain these standards, and the acoustic properties are generally not good.

Up to this point, the neck of the instrument had not been addressed in terms of synthetic materials. The neck of the instrument supports the highly tensioned strings, plus the pressure exerted upon the strings by the player of the instrument. Wooden necks must be made of hard wood, a material of sufficient stiffness to prevent the neck from warping or twisting under the high forces exerted by the strings. Since these hardwoods are heavy, this added weight extending outward from the player makes the instrument harder to play and to hold. For this reason, stiffer and lighter weight materials were chosen to make instrument necks, and this is taught by U.S. Pat. No. 4,145,948 (Turner). It should be noted that claim 3 of Turner's patent calls for "said neck including a pegbox section, a neck section and a soundbox section." It is not clear, however, from this claim just how this is to be accomplished. For example, there is no mention of how to reinforce the neck as it joins the soundbox or the pegbox. This reinforcement is necessary to prevent the neck from creeping and rotating upward in the direction that the string tension is pulling it (a very real problem!). Nor does the wording of this claim specifically mention the integral nature of the molding of the instrument. The claim refers to the neck, which is only a small part of the instrument as a whole.

In U.S. Pat. No. 4,836,076 (Bernier), we see a plastic instrument with reinforcement ribs molded to the internal surfaces of the soundboards, and the neck molded integrally with the lower soundboard. The claims call for a stiffening rib running axially along the center of the inside of the lower soundboard, with a plurality of ribs branching off to the sides from this main rib. Although this design displays the integral molding of the neck, ribs and lower soundboard to which this discussion is leading, it must be pointed out that the claims focus on a particular reinforcement rib pattern that is molded in conjunction with the soundboard. This is quite a disadvantage to sound production in quality instruments, in that these major ribs would provide significant damping or muting of the soundboard vibrations. In the violin family, only one such rib is required, and that is found in the "bass bar" located on the underneath side of the belly, or upper soundboard. What is taught by Bernier is not conducive to graphite/epoxy laminates, however. These laminates do not require such reinforcement since they are superior in strength to molded thermoplastics.

Other graphite/epoxy constructions of violins continue along the trend set forth in the '948 patent, Turner, but use unidirectional materials. These are found as sheets laid in specified orientations for the separate soundboards, the belly and the back. U.S. Pat. No. 4,955,274 (Stephens) is one of these. Again, the design calls for the belly, back and rib to be of separate pieces, indicating the necessary glue joints as potential breakage points. Also, the neck and pegbox are indicated by the patent as being of wood, and as such inherit the various problems associated with wooden necks, as taught by Turner. Similar disadvantages appear also in U.S. Pat. No. 4,408,516 (John). Not only is the John violin built in the manner stated above, but there is no differentiation in the physical shape of the belly versus the back. Violin makers for centuries have specific contours ascribed to each of these, and they are significantly different.

Yet another laminate scheme for the belly only is ascribed in U.S. Pat. No. 5,171,926 (Besnainou et al). It is predicted that the same disadvantages associated with the designs of Stephens and John would exist.

A laminate scheme for guitar manufacture is set forth in U.S. Pat. No. 4,969,381 (Decker) in which a combination of woven fabric and unidirectional sheets are used in the soundboards and sidewalls. This combination, along with cotton or silk fabric on the outside, is purported to be a synthetic equivalent of wood for acoustic purposes. This is good in that the combination of high acoustic damping qualities associated with the woven fabric and the low acoustic damping qualities associated with the unidirectional sheets gives a good, resonant tone. Decker's scheme, however, does not provide for variance in the thickness of the back laminate, a detail through which violin makers for many years have painstakingly worked. It has been shown by our research that good tone is accomplished by a laminate stack of varying shapes and sizes in the back portion of the instrument, and that this varies from violin to viola to cello to string bass. Additionally, Decker's design incorporates the same fragile nature disadvantage found above in Stephens' and John's design.

For centuries, the accepted method used by violin makers to keep the neck from rotating up and forward because of the strings' tension has been to place a large wood block inside the soundbox adjacent to the neck. This block would be fitted and glued to the upper and lower soundboards and to the ribs. Guitar manufacturers perform a similar operation. This block would be trimmed as much as possible to keep from damping the soundboard vibrations, but not so much that the neck would rotate over time. Elimination of this block would be of great help to the acoustical properties of the instrument, and a means is found in U.S. Pat. No. 3,974,730 (Adams, Jr.) Whereby this may be done.

The '730 Adams patent discloses a guitar bracing system in which struts arise from each side of the neck at the place where the sides meet the lower soundboard, and angle up to the center of the upper soundboard. Variations within the design include adjustability of the struts, and various locations for these struts. One of the locations is where the struts originate at the base of the neck block, where the block meets the lower soundboard, and then terminates at a cross brace underneath the upper soundboard. While this is good, a more direct bracing would be obtained if the struts could somehow originate at the top of the neck block, and the angle downwards toward the lower soundboard.

In keeping with this idea, U.S. Pat. No. 4,836,077 (Hogue) promotes the idea of embedding a wooden dowel at an angle downwards through the neck and the neck block. This is aimed more as a repair method for neck blocks that were shown to be too weak to prevent neck rotation, than as a standard manufacturing method for new violins. The design still relies on an accurate glue joint between the block and its faces, which still damps the vibrations of the soundboards somewhat.

SUMMARY OF THE INVENTION

The invention described and claimed herein comprises a composite stringed instrument, illustrated as a violin, in which the body of the violin is molded as a single element out of woven cloth, preferably made of graphite fibers in epoxy, and a plurality of layers of unidirectional fiber sheets bonded to the layer of graphite woven cloth, again by epoxy. Reinforcing struts are adhesively secured between the neck and upper corners of the stringed instrument body. A belly element is separately molded, and a fingerboard is also separately molded, and the belly and fingerboard are appropriately secured to the body. A string assembly is then appropriately secured to the body and disposed over the belly and over the fingerboard.

Among the objects of the present invention are the following:

To provide a new and useful stringed instrument apparatus made of composite material;

To provide a new and useful method of making a stringed instrument;

To provide a new and useful stringed instrument having a unitary molded body; and To provide a new and useful method of making a composite stringed instrument using woven cloth and unidirectional fiber sheets within epoxy resin matrix.

DESCRIPTION OF THE PREFERRED EMBODIMENT

Figure 1:
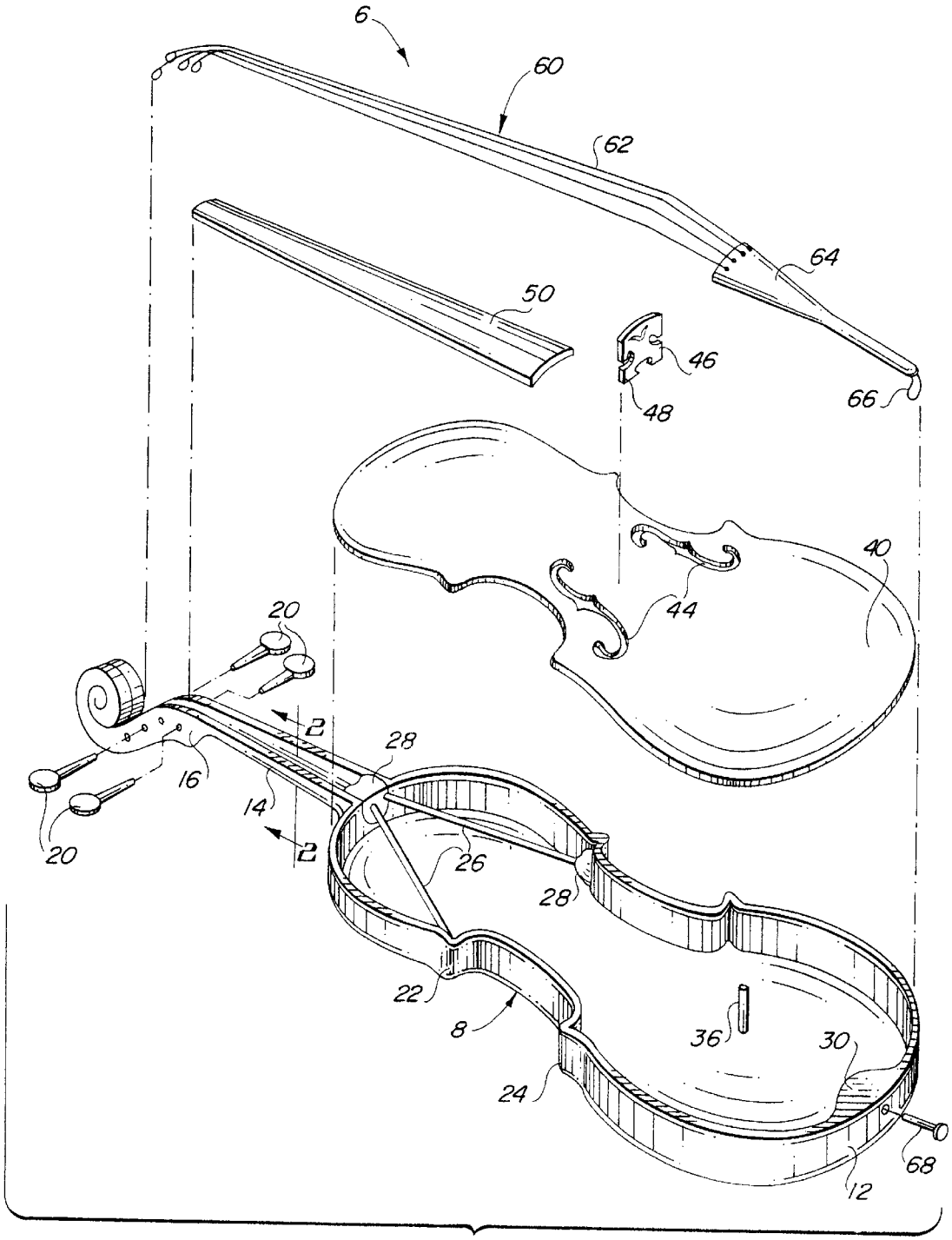
FIG. 1 is a perspective view of the apparatus of the present invention.

FIG. 1 is an exploded perspective view of a stringed instrument 6 embodying the present invention, including a body 8, a belly 40, a fingerboard 50, and a string assembly 60. The stringed instrument 6 is illustrated as a violin.

Figure 3:
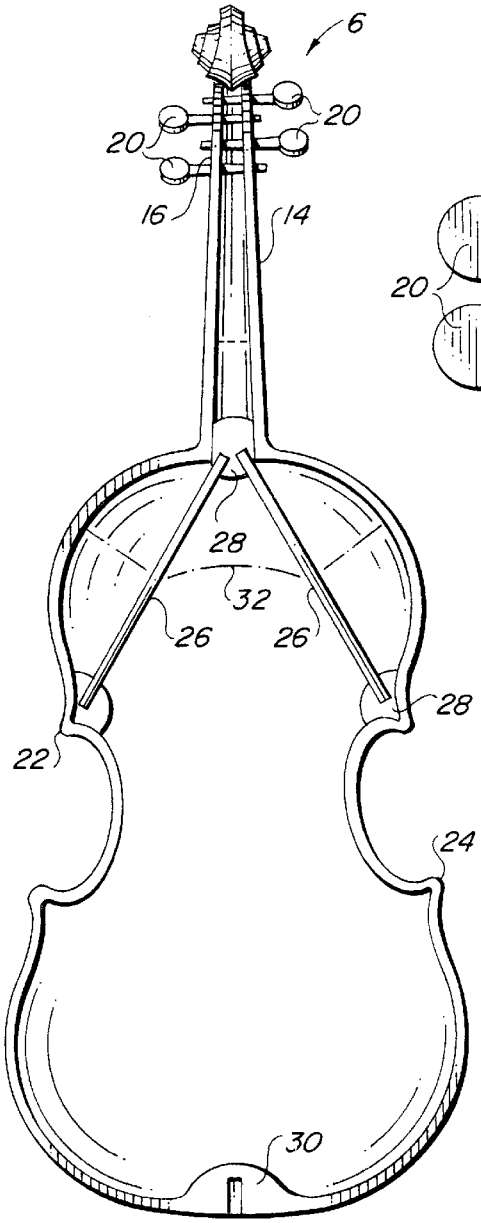
FIG. 3 is a top plan view of a portion of the apparatus of the present invention.
Figure 5:
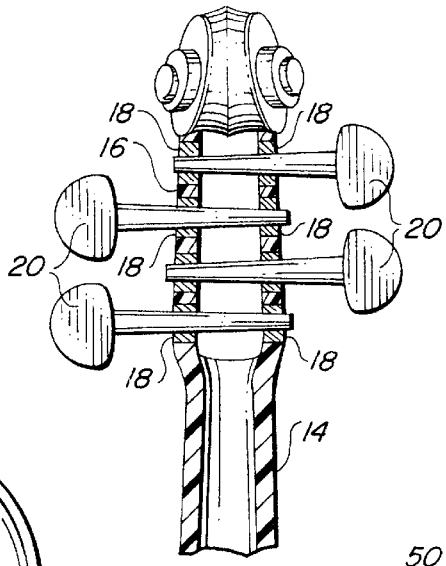
FIG. 5 is a plan view in partial section of a portion of the apparatus of the present invention.
Figure 4:
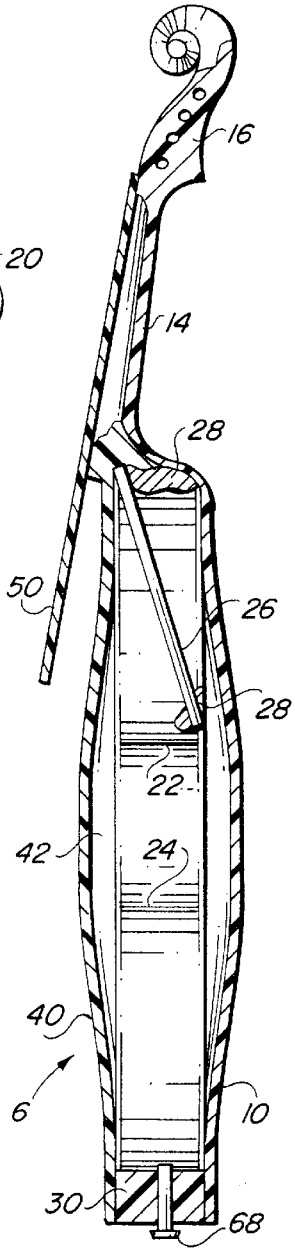
FIG. 4 is a longitudinal view in partial section of the apparatus of the present invention.
Figure 2:
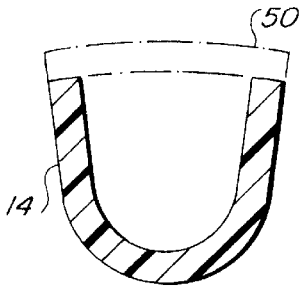
FIG. 2 is a view in partial section through a portion of the apparatus of FIG. 1 taken generally along line 2—2 of FIG. 1.

FIG. 2 is a view in partial section of a portion of the body 8, and FIG. 3 is a top plan view of the body 8. FIG. 4 is a longitudinal view in partial section of the stringed instrument 6, assembled, but without the string assembly 60. FIG. 5 is a view in partial section of a portion of the stringed instrument 6. For the following discussion, reference will be made in general to FIGS. 1, 2, 3, 4, and 5, and specifically to a particular figure as required.

The stringed instrument apparatus 6 includes a composite body 8 molded in a single piece using graphite woven cloth and a plurality of layers of unidirectional fiber sheets. The fibrous material is embedded in matrix of epoxy resin. The body 8 includes a back 10, a rib 12, a neck 14, and a pegbox 16.

The rib 12 extends upwardly from the back 10. Extending outwardly from the rib 12 is the neck 14, and at the outer or distal end of the neck 14 is the pegbox 16. The back 10, the rib 12, the neck 14, and the pegbox 16 are integrally molded together; they are not separately molded or layed up pieces secured together. Rather, they are a single, integral element.

A belly 40 is shown disposed above the body 8. It, too, is made of similar, composite materials, as is the body 8, namely a layer of graphite woven cloth and a multiplicity or plurality of layers of unidirectional fiber sheets embedded in a matrix of epoxy resin. The fingerboard 50 is shown disposed above the body 8 and the belly 40. The fingerboard 50 is of like construction.

All of the various elements are made of the graphite/epoxy composite material so that the coefficient of thermal expansion is the same for all of the components. This precludes warping or twisting of the instrument in temperature extremes, if the instrument should be subject to such temperature extremes.

The rib 12 comprises a perimeter side which extends generally upwardly from the back 10. The rib 12 include a pair of upper corners 22 and a pair of lower corners 24. The portion of the body between the neck and the upper corners 22 is referred to as the upper bout, and the portion of the body between the upper corners 22 and the lower corners 24 is referred to as the C-bout. The portion of the body below the lower corners 24 is referred to as the lower bout.

Extending outwardly from the rib 12 at the upper end of the instrument 6 is the neck 14. The neck 14 is molded as an integral part of the body 8, as discussed above. For weight constraints, the neck 14 is preferably a hollow, U-shaped channel. This is shown in FIG. 2.

At the outer portion of the neck 14 is the pegbox 16. The pegbox 16 is, of course, integral with the neck 14, and it includes a generally U-shaped portion, vertical arm elements of which include a plurality of aligned apertures in which are disposed bushings 18. This is best shown in FIG. 5. The bushings 18 receive pegs 20. The bushings 18 and the pegs 20 are preferably made of a liquid crystal polymer.

Within the body 8, and extending between the neck at the rib 12 and the upper corners 22, is a strut assembly shown in FIGS. 1 and 3 as a pair of tubular graphite struts 26. The struts 26 extend generally downwardly from the upper portion of the neck 14 to the upper corners 22. The struts 26 are appropriately secured to the neck 14 and to the rib 12 at the corners 22 by an appropriate adhesive 28, such as a fiber reinforced resin For larger instruments, such as a cello and a string bass, the strut assembly includes an additional reinforcing laminate plate. The plate is disposed in the neck and extends into the upper portion of the body. The struts are molded to the laminate plate. This is shown in dash dot line in FIG. 3 and identified by reference numeral 32.

Extending through the belly 40 are a pair of "f" holes 44, well known and understood in stringed instruments, such as violins. Disposed between the "f" holes 44, and extending upwardly from the belly 40, is a bridge 46. The bridge 46 includes feet 48 which extend downwardly and are disposed on the belly 40. The bridge 46 is preferably made of maple wood. The bridge is held onto the belly 40 by string tension, as is well known and understood.

As best shown in FIG. 4 a bass bar 42 is shown extending longitudinally on the bottom of the belly 40. The bass bar 42 is, of course, integral with the belly 40.

As indicated above, the fingerboard 50 is made of the same material as the body 8. That is, the fingerboard 50 is made of graphite woven cloth and a plurality of layers of unidirectional graphite fiber sheets in an epoxy matrix.

The fingerboard 50 is appropriately secured to the upper portion of the neck 14. This is best shown in FIG. 4.

The string assembly 60 is shown in FIG. 1 disposed above the fingerboard 50, the bridge 48, and the belly 40. The string assembly 60 includes four strings 62 and a tail piece 64. The strings 62 are secured to one end of the tail piece 64 and extend outwardly therefrom. The outer ends of the strings, remote from the tail piece 64, are secured to the pegs 20 for tuning the strings. At the lower or bottom end of the tail piece 64, remote from the strings 62, is a tail piece adjustor loop 66. The tail piece adjustor loop 66 is secured to the lower or bottom end of the rib 12 of the body 8 by means of an end pin 68. The end pin 68 extends through the rib 12 and into a block 30. The block 30 is also an integral part of the body 8.

As is well known and understood, the strings 62 are appropriately tuned by rotating the pegs 20 in the bushings 18 of the pegbox 16.

A soundpost 36, which is a hollow graphite cylinder, is disposed between the back 10 and the belly 40. The purpose of the soundpost 36 is to transmit vibrations made by the strings between the belly 40 and the back 10.

Figure 6:
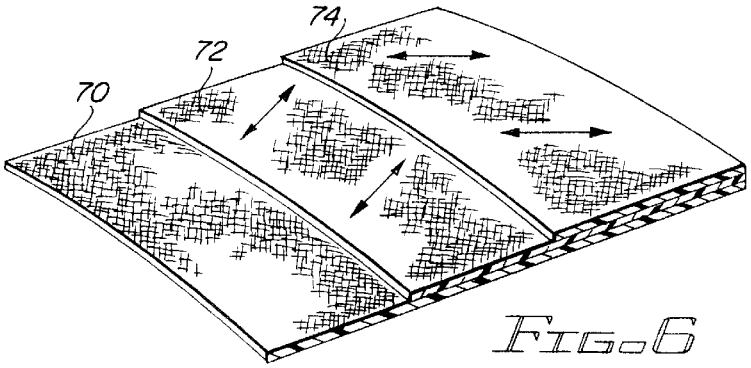
FIG. 6 is a perspective view illustrating the material out of which the apparatus of the present invention is made.

The construction of the stringed instrument 6 is illustrated in FIG. 6, which comprises a perspective view showing three layers of materials disposed one on top of the other. The bottom layer comprises a layer of graphite woven cloth 70. Disposed on top of the graphite woven cloth layer 70 is a sheet of unidirectional graphite fiber 72. On top of the unidirectional fiber sheet 72 is a second unidirectional fiber sheet layer 74. The direction of the fibers in the sheets 72 and 74 are slightly angularly oriented relative to each other. That is, the fiber directions in the respective sheets 72 and 74 are close to parallel. The fiber orientations closely emulate the spruce modulus.

There may be additional layers of unidirectional fiber sheets on top of those illustrated in FIG. 6, as required. As indicated above, the thickness of the body 8 and of the belly 40 are different, and accordingly a different number of layers are found in the body 8 from the belly 40.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A musical stringed instrument comprising in combination:

a body, including
- a back, and
- a rib extending upwardly from the back,
- a pair of upper corners in the rib,
- a neck secured to and integral with the body, and
- a pegbox secured to and integral with the neck remote from the back;

a strut assembly extending from the neck to the upper corners of the rib for stiffening the neck;

a belly secured to the rib;

a fingerboard disposed on the neck;

a bridge disposed on the belly; and a string assembly extending from the pegbox, over the fingerboard and the bridge and secured to the body remote from the neck.

2. The apparatus of claim 1 which further includes a soundpost disposed between the back and the belly.

3. The apparatus of claim 1 in which the strut assembly includes a pair of struts which extend from the neck to the pair of upper corners.

4. The apparatus of claim 3 in which the rib further includes a pair of lower corners spaced apart from the pair of upper corners.

5. The apparatus of claim 3 in which the back, the rib, the neck, the pegbox, and the belly are made of graphite fiber cloth in an epoxy resin matrix.

6. The apparatus of claim 3 which further includes a plurality of pegs extending through the pegbox remote from the body, and the string assembly includes a plurality of strings secured to the plurality of pegs for tuning the strings.

7. The apparatus of claim 6 in which the string assembly further includes a tailpiece to which the strings are secured and which is secured to the body at the rib remote from the neck.

8. The apparatus of claim 7 which further includes a bridge disposed to the belly, and the strings extend over the bridge.

9. The apparatus of claim 8 in which the pegs and the tail piece are made of liquid crystal polymer.

10. The apparatus of claim 1 in which the strut assembly includes a pair of struts.

11. The apparatus of claim 10 in which the strut assembly further includes a reinforcing plate to which the struts are secured.

12. A method of making a stringed instrument, comprising the steps of:

forming a body having a back and a rib extending upwardly from the back;

forming a pair of upper corners in the rib;

forming a neck extending outwardly from and integral with the body;

providing a strut assembly;

securing the strut assembly to the neck and to the upper corners of the rib;

providing a peg box integral with the neck and remote from the back;

forming a belly;

securing the belly to the rib;

providing a fingerboard;

securing the fingerboard to the neck;

providing a bridge;

providing a string assembly;

disposing the string assembly over the fingerboard and the bridge; and securing the string assembly to the pegbox and to the rib.

13. The method of claim 12 which further includes the steps of providing a soundpost and disposing the soundpost between the back and the belly.

14. The method of claim 12 in which the steps of forming the body and the belly includes the step of providing graphite fiber cloth and epoxy resin for forming the body and the belly.

15. The method of claim 14 which the steps of forming the body and the belly further include the step of providing a plurality of unidirectional graphite fiber sheets and layering the unidirectional graphite fiber sheets with the graphite fiber cloth.

16. The method of claim 12 in which the strut assembly includes a pair of struts.

17. The method of claim 12 in which the strut assembly includes a laminate plate and a pair of struts.

* * * * *